US006781061B2

(12) United States Patent
Tanaka

(10) Patent No.: US 6,781,061 B2
(45) **Date of Patent: *Aug. 24, 2004**

(54) FLAT SHIELD CABLE

(75) Inventor: Atsuo Tanaka, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/345,360

(22) Filed: Jan. 16, 2003

(65) Prior Publication Data

US 2003/0146015 A1 Aug. 7, 2003

(30) Foreign Application Priority Data

Feb. 4, 2002 (JP) ..... 2002-027078

(51) Int. Cl.[7] ..... H01B 7/08
(52) U.S. Cl. ..... 174/117 F
(58) Field of Search ..... 174/117 F, 117 FF, 174/36, 110 PM

(56) References Cited

U.S. PATENT DOCUMENTS 4,501,928 A * 2/1985 Ishitobi ..... 174/107
5,416,268 A * 5/1995 Ellis ..... 174/36
6,444,902 B1 * 9/2002 Tsao et al. ..... 174/36
6,531,658 B2 * 3/2003 Tanaka et al. ..... 174/117 F

FOREIGN PATENT DOCUMENTS

JP A 8-212834 8/1996

* cited by examiner

*Primary Examiner*—Chau N. Nguyen
(74) *Attorney, Agent, or Firm*—Oliff & Berridge, PLC

(57) ABSTRACT

A shield cable capable of satisfactorily accommodating electric/electronic equipment newly installed in automobiles requires maintaining good shielding performance, facilitating terminal-processing work, and effectively preventing a buckle and a disconnection in each signal line even if the outer diameter of each signal line is reduced. A flat shield cable is provided having a plurality of signal lines, each having an insulating cover arranged parallel with each other. The signal lines each having the insulating cover are covered with a shield tape having an impedance adjustment intervening tape and a shield layer in such a matter that the shield layer is located outside. A drain line is provided on one side of an array of the signal lines each having the insulating cover so as to be parallel with the signal lines and to be in contact with the shield layer of the shield tape from outside. All of the signal lines, the shield tape, and the drain line are covered with an insulating sheath.

7 Claims, 1 Drawing Sheet

FLAT SHIELD CABLE

BACKGROUND OF THE INVENTION

1. Field of Invention

The present invention relates to a flat shield cable. In particular, the invention relates to a flat shield cable that is suitably used for electrical connection to electric equipment etc. of vehicles such as automobiles. The present application claims priority to Japanese Application No. 2002-027078, filed on Feb. 4, 2002.

2. Description of Related Art

In vehicles such as automobiles, shield cables are used for electrical connection to electric equipment etc. FIG. 1 shows a conventional flat shield cable 1 generally having a structure in which a plurality of signal lines 2, each having an insulating cover, and a drain line 3 are twisted together and covered with a shield layer 4, which is covered with an insulating sheath 5. Each signal line 2 is composed of a core conductor 2*a* and an insulating cover 2*b* that covers the core conductor 2*a*.

Incidentally, the common components of the conventional shield cable 1 of the above kind have the following specifications. The cross-sectional area (hereinafter also referred to as "conductor size") of each signal line 2 is 0.3 $mm^2$, the outer diameter of the core conductor 2*a* of each signal line 2 is 1.4 mm, the material of the insulating cover 2*b* is polyvinyl chloride (PVC), the material of the drain line 3 is copper or aluminum, the material of the shield layer 4 is copper or aluminum, and the material of the insulating sheath 5 is poly(vinly chloride), polyethylene, or the like.

With the above configuration, external noise is interrupted by the shield layer 4 and led to an external ground via the drain line 3, whereby good signals are supplied to various kinds of electric equipment through the signal lines 2.

On the other hand, with the recent rapid development of car navigation and DVD equipment, a monitor, a DVD unit, or the like has come to be installed in automobiles. Such electric/electronic equipment has come to be newly installed in automobiles provides pictures, sounds, etc. with improved resolution or quality. Car navigation monitors, for example, can experience blurring in an enlarged picture of a road map etc. Thus, a certain countermeasure is desired. In particular, a shield cable having better electrical performance, specifically, a better characteristic impedance, is required.

In conventional shield cables, the signal lines 2 and the drain line 3 are twisted together. Therefore, terminal-processing work (i.e., connection to a connector terminal) is difficult to perform and takes time. Further, a terminal processing length (i.e., a length over which the insulating sheath 5 and the shield layer 4 need to be stripped away) of about 80 mm is needed, which causes a problem that the shielding performance deteriorates at a terminal.

The standards for connectors of the electrical/electronic equipment that are newly incorporated in automobiles require that the outer diameter of each signal line 2 be 1.3 mm. However, in the standards for conventional connectors, the outer diameter of each signal line 2 is mainly 1.4 to 1.6 mm (the diameter of a finished signal line is equal to 1.4 mm when the conductor size is 0.3 $mm^2$). As such, conventional connectors do not conform to the equipment that has come to be newly incorporated in automobiles; it is indispensable to reduce the outer diameter of each signal line 2. This results in a problem that a buckle or a disconnection likely occurs in the core conductor 2*a* of the outside signal line 2 when bending stress is applied to the shield cable 1 in the lateral direction.

SUMMARY OF THE INVENTION

An object of the present invention is to solve the above problems in the art and thereby provide a shield cable capable of satisfactorily accommodating electric/electronic equipment that has come to be newly installed in automobiles, maintaining good shielding performance, facilitating terminal-processing work, and effectively preventing a buckle and a disconnection in each signal line even if the outer diameter of each signal line is reduced.

The present inventor has studied intensively to solve the above problems in the art and has completed the present invention by finding out the following. The characteristic impedance of each signal line is strongly related to the problem of the above-mentioned electric/electronic equipment newly installed in automobiles. The impedance has a value of about 50 Ω in conventional cables. When connection is made to such equipment as a DVD unit or a monitor by using a conventional shield cable, impedance mismatch causes reflection between the signal supply side and the equipment side, which is considered the cause of the above problem. It has been found that increasing the characteristic impedance of each signal line to about 75 Ω (±10%) attains impedance matching and can thereby solve the above problem. On the other hand, to satisfy the standards for connectors of the new electric/electronic equipment, the outer diameter of each signal line must be 1.3 mm. A desired characteristic impedance can be obtained by adjusting the cross-sectional area (conductor size) of the core conductor of each signal line and the dielectric constant of the insulating cover of each signal line in consideration of the above factors.

That is, according to the invention, the above object is attained by the following technical means:

(1) A flat shield cable wherein a plurality of signal lines each having an insulating cover are arranged parallel with each other; the plurality of signal lines each having the insulating cover are covered with a shield tape having an impedance adjustment intervening tape and a shield layer in such a matter that the shield layer is located outside; a drain line is provided on one side of an array of the plurality of signal lines each having the insulating cover so as to be parallel with the plurality of signal lines and to be in contact with the shield layer of the shield tape from outside; and all of the plurality of signal lines, the shield tape, and the drain line are covered with an insulating sheath.

(2) The flat shield cable according to item (1), wherein each of the signal lines has an outer diameter of 1.3 mm, a core conductor of each of the signal lines has a cross-sectional area of 0.13 to 0.22 $mm^2$, the insulating cover of each of the signal lines is made of an insulating material having a relative dielectric constant of 1.7 to 2.8, and each of the signal lines has a characteristic impedance of 75 Ω (±10%).

(3) The flat shield cable according to item (1) or (2), wherein the drain line has a cross-sectional area of 0.22 to 0.5 $mm^2$.

(4) The flat shield cable according to any one of items (1) to (3), wherein the insulating cover of each of the signal lines is made of foamed polyethylene.

DETAILED DESCRIPTION OF PREFERRED EMBODIMENTS

Figure 1:
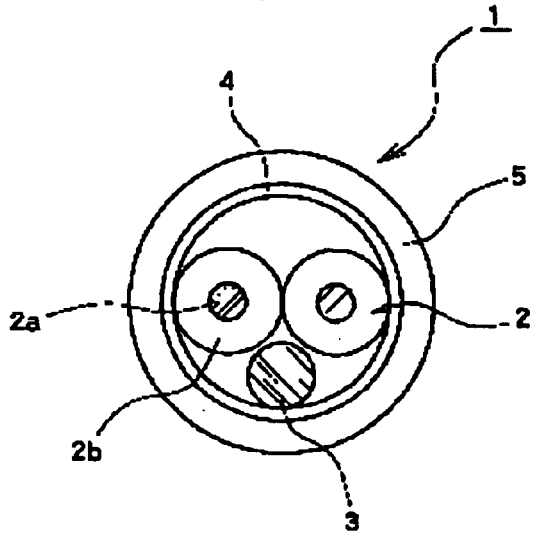
Fig. 1 (RELATED ART)
FIG. 1 is a sectional view showing the structure of a conventional shield cable.
Figure 2:
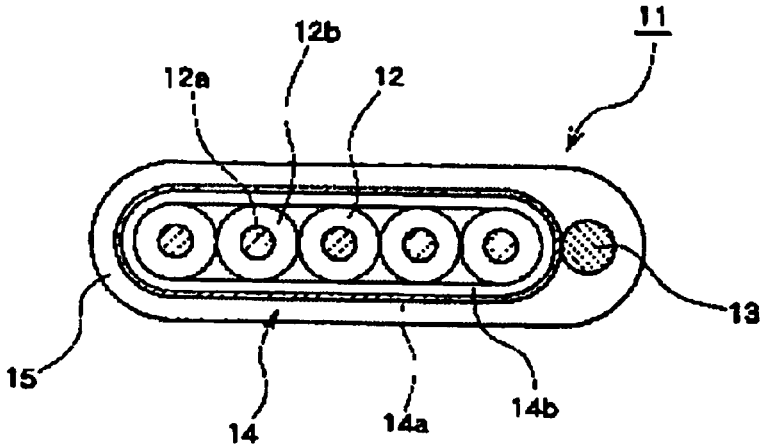
FIG. 2 is a sectional view showing the structure of a flat shield cable according to an embodiment of the present invention.

A preferred embodiment of the present invention will be hereinafter described. FIG. 2 shows the flat shield cable 11 according to one embodiment having a flat structure with a plurality of signal lines 12. Each of the signal lines 12 has an insulating cover arranged parallel with each other and covered with a shield tape 14 having an impedance adjustment intervening tape 14*b* and a shield layer 14*a*. A drain line 13 is provided on one side of the array of the signal lines 12, each having the insulating cover, so as to be parallel with the signal lines 12 and to be in contact with the shield layer 14*a* of the shield tape 14 from outside. All of the signal lines 12, the shield tape 14, and the drain line 13 are covered with an insulating sheath 15. Each signal line 12 is composed of a core conductor 12*a* and an insulating cover 12*b*.

The outer diameter of each signal line 12 is set to 1.3 mm and may include a nominal error. In the invention, from the viewpoint of preventing impedance mismatch, it is preferable that the characteristic impedance of each signal line 12 be 75 Ω (±10%), that is, 67.5 to 82.5 Ω. From the viewpoint of enabling transmission of a good signal and maintaining sufficient strength, it is preferable that the conductor size of the core conductor 12*a* of each signal line 12 be 0.05 to 0.22 $mm^2$. The core conductor 12*a* may be made of a metal or alloy material such as copper, aluminum, or tin-plated copper and may be either twisted wires or a single wire.

This allows the characteristic impedance to fall within the above range, it is preferable that the insulating cover 12*b* of each signal line 12 be made of an insulating material having a relative dielectric constant of 1.7 to 2.8. Examples of such a material are resin materials such as foamed polyethylene and polytetrafluoroethylene. Foamed polyethylene is particularly preferable from the viewpoint of cost, durability, etc. Foamed polyethylene can exhibit a relative dielectric constant in the above range when its expansion ratio is adjusted. The thickness of the insulating cover 12*b* is set as appropriate in accordance with the conductor size of the core conductor 12*a* (because the outer diameter of each signal line 12 is determined). The number of parallel signal lines 12 can be set arbitrarily so as to be suitable for a use though the five signal lines 12 are shown in FIG. 2.

The drain line 13 is made of a metal or alloy material such as annealed copper or tin-plated copper and may be either twisted wires or a single wire. From the viewpoint of reinforcement of the signal lines 12 and compatibility with connector terminal dimensions, it is preferable for the conductor size of the drain line 13 to be about 0.22 to 0.5 $mm^2$. As mentioned above, the drain line 13 is provided in such a manner as to be in contact with the shield layer 14*a* from outside the shield tape 14. Hence, the drain line 13 is not wrapped in the shield tape 14.

The shield tape 14 is composed of the shield layer 14*a* and an impedance adjustment intervening tape 14*b*. The shield layer 14*a* is made of a material that exhibits a shielding effect, such as a metal or alloy material, examples of which are copper, aluminum, and tin-plated copper. The impedance adjustment intervening tape 14*b* is made of a resin material having a small dielectric constant $\epsilon$ (relative dielectric constant: 1.7 to 2.8), such as PET (polyethylene terephthalate). The thickness of the impedance adjustment intervening tape 14*b* is about 0.25 to 0.45 $\mu$m. Conventionally, a desired impedance is secured by increasing the thickness of the insulating cover of each signal line 12. Where there is a limitation on the thickness of the insulating cover of each signal line 12, the impedance can be adjusted by imparting the impedance adjustment function to the impedance adjustment intervening tape 14*b*.

The insulating sheath 15 is made of a material that is insulative, oil-resistant, and chemical-resistant. Resin materials such as PVC (polyvinyl chloride), polyethylene, halogen-free materials, and polytetrafluoroethylene may be used. The thickness of the insulating sheath 15 is about 0.3 to 0.4 mm.

Actually produced examples of the flat shield cable 11 according to the invention will be described below.

A flat shield cable 11 having the structure of FIG. 2 was produced in the following manner. Twisted wires made of tin-plated annealed copper (conductor size: 0.13 $mm^2$) were used as a core conductor 12*a*, foamed polyethylene (relative dielectric constant: 1.7; thickness: 0.425 mm) was used as a insulating cover 12*b*, twisted wires made of tin-plated annealed copper (conductor size: 0.22 $mm^2$) were used as a drain line 13, copper foil (thickness: 9 $\mu$m) was used as a shield layer 14*a*, PET film (thickness: 0.25 mm) was used as an impedance adjustment intervening tape 14*b*, and a halogen-free material (thickness: 0.3 mm) was used as an insulating sheath 15. Five signal lines 12 were used. The flat shield cable 11 thus produced had a characteristic impedance of 70 Ω.

Another flat shield cable 11 having the structure of FIG. 2 was produced in the following manner. Twisted wires made of tin-plated annealed copper (conductor size: 0.22 $mm^2$) were used as a core conductor 12*a*, foamed polyethylene (relative dielectric constant: 1.7; thickness: 0.375 mm) was used as a insulating cover 12*b*, twisted wires made of tin-plated annealed copper (conductor size: 0.22 $mm^2$) were used as a drain line 13, copper foil (thickness: 9 $\mu$m) was used as a shield layer 14*a*, PET film (thickness: 0.45 mm) was used as an impedance adjustment intervening tape 14*a* and a halogen-free material (thickness: 0.3 mm) was used as an insulating sheath 15. Five signal lines 12 were used. The flat shield cable 11 thus produced had a characteristic impedance of 70 Ω.

A terminal-processing work on the flat shield cable according to the invention is as follows. The shield tape and the insulating sheath in a terminal portion are stripped away over a length of about 20 mm, and the tips of the signal lines and the drain line are formed by a terminal-processing machine so as to be suitable for the pitch of an equipment-side connector and are connected to the equipment-side connector simultaneously. This prevents the shielding performance from deteriorating at a terminal and facilitates terminal-processing work.

According to the invention, by virtue of the employment of the above configuration, the outer diameter of each signal line falls within the size of an equipment-side connector. This enables application to such equipment as a DVD unit and a monitor that is installed in automobiles etc. Because impedance matching with such equipment can be established, a problem such as blurring in a monitor picture can be prevented.

By virtue of the flatness of the flat shield cable according to the invention, connection to a connector can be performed at one time, which facilitates terminal-processing work.

In the flat shield cable according to the invention, a terminal processing length (i.e., a length over which the shield tape and the insulating sheath should be stripped away) can be as short as about 20 mm. This makes it possible to secure good shielding performance at a terminal.

Further, the flat shield cable according to the invention is lighter and occupies a smaller space than conventional shield cables.

While this invention has been described in conjunction with the specific embodiments above, it is evident that many alternatives, combinations, modifications, and variations are apparent to those skilled in the art. Accordingly, the exemplary embodiments of this invention, as set forth above are intended to be illustrative, and not limiting. Various changes can be made without departing from the spirit and scope of this invention.

What is claimed is:

1. A flat shield cable comprising:

a plurality of signal lines, each line having an insulating cover arranged parallel with each other;

a shield tape having an impedance adjustment intervening tape covering the plurality of signal lines and a shield layer covering the impedance adjustment intervening tape, wherein the impedance adjustment insulating tape is made of a resin material having a dielectric constant between 1.7 and 2.8;

a drain line provided on one side of an array of the plurality of signal lines, each having the insulating cover, so as to be parallel with the plurality of signal lines and to be in contact with the shield layer of the shield tape from outside; and an insulating sheath covering all of the plurality of signal lines, the shield tape, and the drain line, wherein each of the signal lines has an outer diameter of 1.3 mm, a core conductor of each of the signal lines has a cross-sectional area of 0.13 to 0.22 $mm^2$, the insulating cover of each of the signal lines is made of an insulating material having a relative dielectric constant of 1.7 to 2.8, and each of the signal lines has a characteristic impedance of 75 Ω±10%.

2. The flat shield cable according to claim 1, wherein the drain line has a cross-sectional area of 0.22 to 0.5 $mm^2$.

3. The flat shield cable according to claim 1, wherein the insulating cover of each of the signal lines is made of foamed polyethylene.

4. The flat shield cable according to claim 1, wherein the impedance adjustment intervening tape is made of polyethylene terephthalate.

5. A flat shield cable comprising:

a plurality of signal lines, each line having an insulating cover arranged parallel with each other;

a shield tape having an impedance adjustment intervening tape covering the plurality of signal lines and a shield layer covering the impedance adjustment intervening tape, wherein the impedance adjustment insulating tape is made of a resin material having a dielectric constant between 1.7 and 2.8;

a drain line provided on one side of an array of the plurality of signal lines, each having the insulating cover, so as to be parallel with the plurality of signal lines and to be in contact with the shield layer of the shield tape from outside; and an insulating sheath covering all of the plurality of signal lines, the shield tape, and the drain line, wherein the drain line has a cross-sectional area of 0.22 to 0.5 $mm^2$.

6. The flat shield cable according to claim 5, wherein the insulating cover of each of the signal lines is made of foamed polyethylene.

7. A flat shield cable comprising:

a plurality of signal lines, each line having an insulating cover arranged parallel with each other;

a shield tape having an impedance adjustment intervening tape covering the plurality of signal lines and a shield layer covering the impedance adjustment intervening tape, wherein the impedance adjustment insulating tape is made of a resin material having a dielectric constant between 1.7 and 2.8;

a drain line provided on one side of an array of the plurality of signal lines, each having the insulating cover, so as to be parallel with the plurality of signal lines and to be in contact with the shield layer of the shield tape from outside; and an insulating sheath covering all of the plurality of signal lines, the shield tape, and the drain line, wherein the insulating cover of each of the signal lines is made of foamed polyethylene.

* * * * *